US006119781A

United States Patent [19]

Lemetayer et al.

[11] Patent Number: 6,119,781

[45] Date of Patent: Sep. 19, 2000

[54] METHOD OF OPERATING AN OIL AND GAS PRODUCTION WELL ACTIVATED BY A PUMPING SYSTEM

[75] Inventors: Pierre Lemetayer; Christian Fouillout, both of Pau; Michel Casagrande, Serres Ste Marie, all of France

[73] Assignee: Elf Exploration Production, Courbevoie, France

[21] Appl. No.: 09/244,047

[22] Filed: Feb. 4, 1999

[30] Foreign Application Priority Data

Feb. 13, 1998 [FR] France ..... 98 01782

[51] Int. Cl.[7] ..... E21B 43/04; E21B 43/00

[52] U.S. Cl. ..... 166/369; 166/53; 166/105.15

[58] Field of Search ..... 166/53, 66, 105, 166/250.01, 250.15, 369; 417/56, 57

[56] References Cited

U.S. PATENT DOCUMENTS

| | | | |
|---|---|---|---|
| Re. 34,111 | 10/1992 | Wynn | 166/53 |
| 4,676,313 | 6/1987 | Rinaldi | 166/252.1 |
| 4,989,671 | 2/1991 | Lamp | 166/53 |
| 5,193,985 | 3/1993 | Escue et al. | 417/53 |
| 5,634,522 | 6/1997 | Hershberger | 166/372 |
| 5,819,848 | 10/1998 | Rasmuson et al. | 166/250.15 |
| 5,823,262 | 10/1998 | Dutton | 166/250.15 |
| 5,941,305 | 8/1999 | Thrasher et al. | 166/53 |
| 5,967,234 | 10/1999 | Shaposhnikov et al. | 166/373 |
| 6,006,832 | 12/1999 | Tubel | 166/250.021 |

*Primary Examiner*—David Bagnell
*Assistant Examiner*—Jennifer R. Dougherty
*Attorney, Agent, or Firm*—Blank Rome Comisky & McCauley, LLP

[57] ABSTRACT

The invention relates to the production of hydrocarbons in the form of oil and gas, from a well activated by a pumping system. According to the invention, a hydrocarbon production well comprising a submerged pump (5) driven by an electric motor (6), an oil outlet choke (17) and a gas venting choke (22) is operated by acting, during the various production phases, on the chokes and on the speed of the electric motor (6) either in turn or simultaneously. Furthermore, correct operation of the well is constantly checked and it is also checked that the current drawn by the motor (6) does not cross thresholds that vary as a function of the speed of the motor (6). The invention finds its application in the oil industry.

20 Claims, 3 Drawing Sheets

METHOD OF OPERATING AN OIL AND GAS PRODUCTION WELL ACTIVATED BY A PUMPING SYSTEM

TECHNICAL FIELD

The present invention relates to a method of operating an oil- and gas-producing oil well activated by a submersible downhole pumping system.

STATE OF THE PRIOR ART

In the case of certain oil wells, the rate at which hydrocarbons are produced in the form of oil and gas is low because of the low pressure in the reservoir.

In order to increase the production of hydrocarbons, use is conventionally made of a method known by the name of an electrical submersible pumping method.

According to this method, a pumping system comprising a pump driven by an electric motor is placed in the wellbottom, so as to suck oil in from the hydrocarbons reservoir and deliver it into a production column which connects the wellbottom at reservoir level with the well head at the top.

The electrical power supply for the motor is usually provided by a frequency converter which allows the rotational speed of the pump to be varied.

The production column defines, with the casing that forms the wall of the well, an annular space which allows the venting of the excess free gas under the wellbottom thermodynamic conditions.

At the top of the well, the production column is connected to a pipe equipped with an oil outlet choke, and the annular space is extended by another pipe equipped with a gas venting choke. These two chokes allow the oil outlet flow rate and gas venting flow rate respectively to be regulated.

One method of operating such a well, described in U.S. Pat. No. 5,634,522, consists in slaving the measured level to which the oil rises in the annular space to a predetermined reference value by acting on the extent to which the oil outlet choke is open.

It is also known practice for the motor speed to be increased linearly as a function of time during the initial start-of-production phase and during a restart after a stoppage.

The electric motor is conventionally protected against excessive heating by a circuit breaker which cuts off the electric power supply when the current drawn exceeds a very high fixed threshold value.

This protection has the drawback of not being effective under all well operating conditions. For example, when the flow rate of the oil produced is low, as the current drawn by the motor is low, the Joule-effect heating is small, but the amount of cooling provided by the oil which flows through the motor is also low. Under such conditions, the combination of these two opposite effects may result in an excessive temperature rise in the motor without the protective device being able to come into action because the very high drawn-current threshold has not been exceeded. Such rises in temperature lead, over time, to degradation of the motor and eventually lead to damage thereto.

Other thermodynamic, thermal and hydraulic phenomena may temporarily lead to an excess of free gas in the pump. This excess of gas may, in certain cases, lead to instabilities or to insufficient cooling. These phenomena, which have an influence on the life of the motor and of the pump are not taken into account in the known operating methods.

Another drawback of these known methods is that any anomaly in operation leads to production being stopped and to costly restarts.

SUMMARY OF THE INVENTION

The precise purpose of the present invention is to overcome these drawbacks by proposing a method of operating an oil well activated by an electric submersible pump pumping system, which improves the protection of the pump and of its electric drive motor under all operating conditions, which reduces the effects of thermal and hydraulic shock, and which ensures consistency between the settings of the power supply to the electric motor and the settings of the well outlets in order to minimize production stoppages.

By virtue of the invention, the life of the pumping system is increased and the number of costly repair interventions and associated costly restarts is greatly reduced.

To this end, the invention proposes a method of operating an oil and gas production well activated by a pumping system, comprising, placed at the wellbottom, a submerged pump driven by an electric motor which draws a known amount of current, the said well comprising, at its top, an oil outlet choke and a gas venting choke, characterized in that it comprises a starting phase which consists in running the following steps:

- a preparative step which consists in:
  - acting on the gas venting choke to bring the pressure upstream of the said choke to a predetermined starting value,
  - acting on the oil outlet choke to bring the pressure upstream of the said choke to a predetermined starting value,
  - re-closing the oil outlet choke,
  - checking that, with no power applied to the electric motor, the condition of the pump is compatible with starting,
- a start-of-production step which consists in:
  - gradually applying power to the motor until the pump is running at a predetermined minimum speed,
  - checking, after a time, that the pressure upstream of the oil outlet choke has exceeded a predetermined pressure-rise threshold,
  - checking, after a time, that the current drawn by the electric motor has exceeded a predetermined threshold,
  - leaving the pump running if these two thresholds have been exceeded, otherwise stopping the pump,
  - gradually increasing the extent to which the oil outlet choke is open, up to a predetermined value,
  - waiting for a predetermined stabilizing time,
  - checking for correct operation by simultaneously making checks on the current drawn by the motor and on the production of the well using at least one production indicator,
  - regulating the pressure upstream of the gas venting choke to the predetermined starting value.

According to another feature of the invention, the compatibility of the condition of the pump with starting comprises the following checks:

- that the pump, rotating and equipped with a direction-of-rotation sensor is not running in the opposite direction to its normal direction of rotation,
- that the time between two successive attempts at starting exceeds a predetermined value,
- that after a predetermined number of attempts at starting in a predetermined time, the next attempt does not occur until a predetermined time has elapsed.

According to another feature of the invention, with the current drawn by the motor being compared with very high and very low thresholds independent of the speed of the motor, a crossing of one of the said thresholds causing the pump to be stopped, the checks on the current drawn by the electric motor for checking correct operation, additionally consist in:

comparing the value of the said current with a low threshold and, if the threshold has been crossed and if the time for which it is crossed exceeds a predetermined value, stopping the pump, after a predetermined time, checking the stability of the said current and if an instability is detected and if the duration of the instability exceeds a predetermined value, stopping the pump.

According to another feature of the invention, the checks on the production of he well consist in taking as a production indicator at least one physical variable that indicates the oil outlet flow and in comparing the value of the said variable with a predetermined threshold, the threshold being considered as actually having been exceeded when it is so continuously for a predetermined duration, and if the threshold has been exceeded, in stopping the pump.

According to another feature, after the starting phase, under production conditions, the invention consists in simultaneously performing the following operations:

increasing the speed of the motor up to a predetermined target value, opening the oil choke up to a value that is calculated as a function of the target value of the speed of the motor, acting on the gas venting choke so as to keep the pressure upstream of the said choke at a value that is calculated as a function of the target value of the speed of the motor, then checking for correct operation by performing checks on the current drawn by the motor and on the well production, using production indicators.

According to another feature of the invention, the extent to which the oil outlet choke is open is calculated by applying the following formula:

$$Soil=\alpha(V-Vmin)+Smin \text{ if } Vmin<V<Vmax$$

in which:

Soil represents the extent to which the oil outlet choke is open

V represents the target value of the speed of the electric motor $\alpha$ is a constant Smin is a constant which represents the minimum extent to which the oil outlet choke is open Vmin and Vmax respectively represent the minimum and maximum speeds of the motor, $\alpha$, Smin, Vmin and Vmax are determined from characteristics of the well, of the pump and of the motor.

According to another feature of the invention, the pressure upstream of the gas venting choke is calculated by applying the following formula:

$$Pgas=\beta(V-Vmin)+Po \text{ if } Vmin<V<Vmax$$

in which

Pgas represents the pressure upstream of the gas venting choke,

V represents the target value of the speed of the electric motor $\beta$ is a constant Po is a constant Vmin and Vmax respectively represent the minimum and maximum speeds of the motor, $\beta$, Po, Vmin and Vmax are determined from characteristics of the well, of the pump and of the motor.

According to another feature of the invention, under production conditions, with the current drawn by the motor being compared with very high and very low thresholds independent of the speed of the motor, a crossing of one of the said thresholds causing the pump to be stopped, the checks on the current drawn by the electric motor for checking correct operation, additionally consist in:

comparing the value of the said current with high and low thresholds which vary as a function of the speed of the motor, if a threshold is crossed, reducing the speed, and if the threshold is still crossed, stopping the pump, checking the stability of the said current, and if an instability is detected, reducing the speed to a predetermined value, and if the duration of the instability exceeds a predetermined value, stopping the pump.

According to another feature of the invention, under production conditions, the high and low thresholds that vary as a function of the speed are calculated by applying the following formulae:

$$Ihigh=INmin+\gamma(V-Vmin)+\Delta I \text{ if } Vmin<V<Vmax$$

$$Ilow=INmin+\gamma(V-Vmin)-\Delta I \text{ if } Vmin<V<Vmax$$

in which:

Ihigh represents the high threshold for the current drawn by the motor,

Ilow represents the low threshold for the current drawn by the motor,

V represents the speed of the electric motor,

INmin is a constant which represents the minimum nominal value of the current drawn by the motor, Vmin and Vmax respectively represent the minimum and maximum values of the speed of the motor determined from characteristics of the well, of the pump and of the motor, $\gamma$ and $\Delta I$ are constants calculated for each well from characteristics of the motor.

According to another feature of the invention, the checks on the production of the well consist in taking as a production indicator at least one physical variable that indicates the oil outlet flow and in comparing the value of the said variable with at least one predetermined threshold, the threshold being considered as actually having been exceeded when it is so continuously for a predetermined duration, and if the threshold has been exceeded, in reducing the speed.

According to another feature of the invention, the physical variable that indicates the oil outlet flow is chosen from the group consisting of a pressure difference created by a restriction on the oil outlet, the vent gas flow, the wellbottom pressure upstream of the pump, the pressure upstream of the oil outlet choke and the oil outlet temperature.

According to another feature, with the well being equipped with a safety device, the invention consists in closing the oil outlet and gas venting chokes and in stopping the motor immediately when the safety device comes into action, to strengthen its own actions.

Another subject of the invention is a method of operating an oil and gas production well activated by a pumping system, comprising, placed at the wellbottom, a submerged pump driven by an electric motor which draws a known amount of current, the said well comprising, at its top, an oil outlet choke and a gas venting choke, characterized in that after a starting phase it consists in simultaneously performing the following operations:

increasing the speed of the motor up to a predetermined target value, opening the oil-outlet choke up to a value that is calculated as a function of the target value of the speed of the motor, acting on the gas venting choke so as to keep the pressure upstream of the said choke at a value that is calculated as a function of the target value of the speed of the motor, then checking for correct operation by performing checks on the current drawn by the motor and on the well production, using production indicators.

According to another feature of the invention, under production conditions, the extent to which the oil outlet choke is open is calculated by applying the following formula:

$$Soil=\alpha(V-Vmin)+Smin \text{ if } Vmin<V<Vmax$$

in which:

Soil represents the extent to which the oil outlet choke is open

V represents the target value of the speed of the electric motor $\alpha$ is a constant Smin is a constant which represents the minimum extent to which the oil outlet choke is open Vmin and Vmax respectively represent the minimum and maximum speeds of the motor, $\alpha$, Smin, Vmin and Vmax are determined from characteristics of the well, of the pump and of the motor.

According to another feature of the invention, the pressure upstream of the gas venting choke is calculated by applying the following formula:

$$Pgas=(V-Vmin)+Po \text{ if } Vmin<V<Vmax$$

in which:

Pgas represents the pressure upstream of the gas venting choke,

V represents the target value of the speed of the electric motor, $\beta$ is a constant Po is a constant Vmin and Vmax respectively represent the minimum and maximum speeds of the motor, $\beta$, Po, Vmin and Vmax are determined from characteristics of the well, of the pump and of the motor.

According to another feature of the invention, with the current drawn by the motor being compared with very high and very low thresholds independent of the speed of the motor, a crossing of one of the said thresholds the pump being stopped, the checks on the current drawn by the electric motor for checking correct operation, additionally consist in:

comparing the value of the said current with high and low thresholds calculated as a function of the speed of the motor, if a threshold is crossed, reducing the speed and if the threshold is still crossed, stopping the pump, checking the stability of the said current, and if an instability is detected, reducing the speed to a predetermined value, and if the duration of the instability exceeds a predetermined value, stopping the pump.

According to another feature of the invention, the high and low thresholds are calculated by applying the following formulae:

$$Ihigh=INmin+\gamma(V-Vmin)+\Delta I \text{ if } Vmin<V<Vmax$$

$$Ilow=INmin+\gamma(V-Vmin)-\Delta I \text{ if } Vmin<V<Vmax$$

in which:

Ihigh represents the high threshold for the current drawn by the motor,

Ilow represents the low threshold for the current drawn by the motor,

V represents the speed of the electric motor, INmin is a constant which represents the minimum nominal value of the current drawn by the motor, Vmin and Vmax respectively represent the minimum and maximum values of the speed of the motor determined from characteristics of the well, of the pump and of the motor, $\gamma$ and $\Delta I$ are constants calculated for each well from characteristics of the motor.

According to another feature of the invention, the checks on the production of the well consist in taking as a production indicator at least one physical variable that indicates the oil outlet flow and in comparing the value of the said variable with at least one predetermined threshold, the threshold being considered as actually having been exceeded when it is so continuously for a predetermined duration, and if the threshold has been exceeded, in reducing the speed.

According to another feature of the invention, the physical variable that indicates the oil outlet flow is chosen from the group consisting of a pressure difference created by a restriction on the oil outlet, the vent gas flow, the wellbottom pressure upstream of the pump, the pressure upstream of the oil outlet choke and the oil outlet temperature.

According to another feature, with the well being equipped with a safety device, the invention consists in closing the oil outlet and gas venting chokes and in stopping the motor immediately when the safety device comes into action, to strengthen its own actions.

DETAILED DESCRIPTION OF THE INVENTION

In general, the method of the invention is used for operating a hydrocarbons production well activated by a pumping system.

Figure 1:
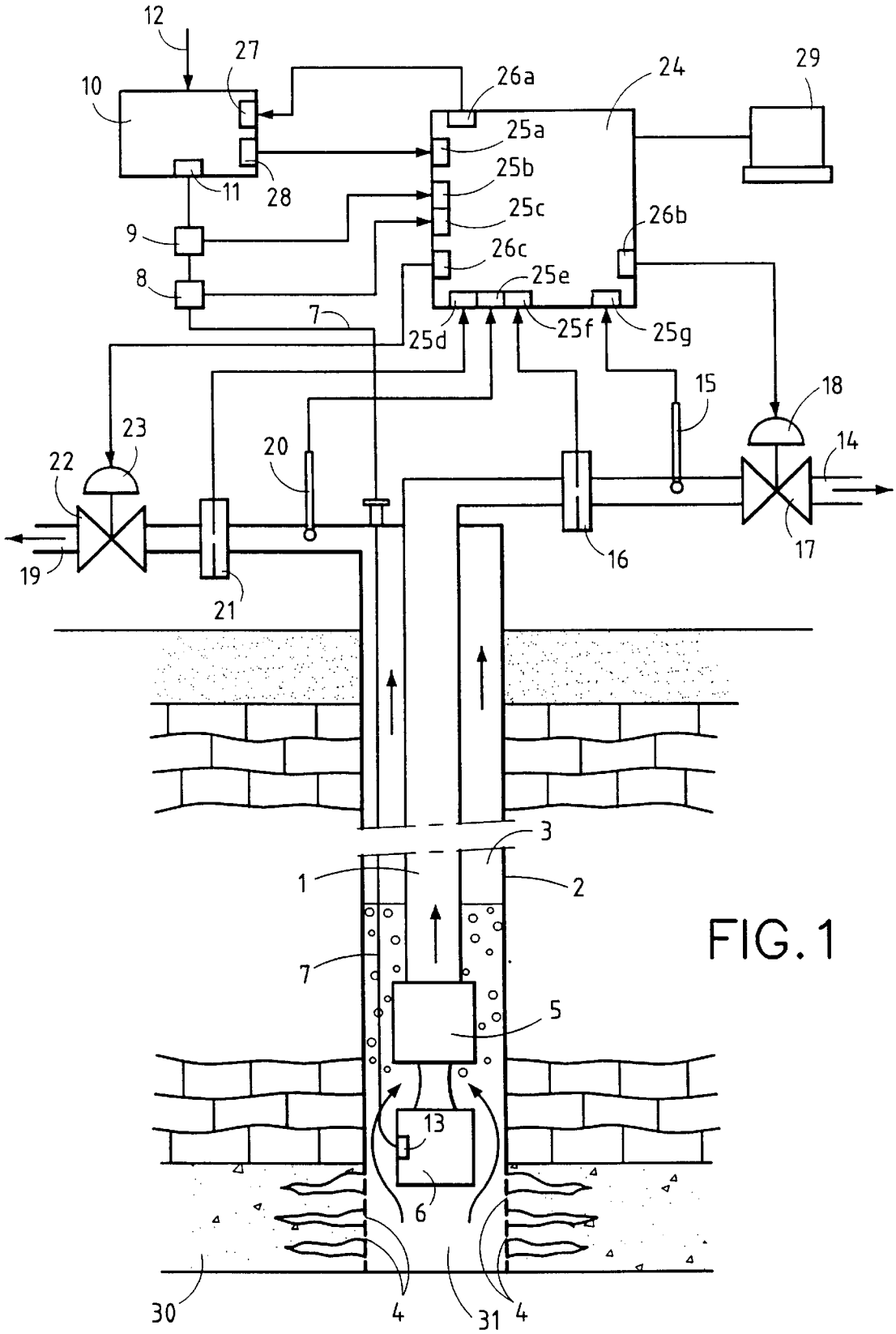
FIG. 1 diagrammatically depicts a well for producing hydrocarbons in the form of oil and gas, activated by a submersible pumping system.

FIG. 1 represents a hydrocarbons production well which comprises:

a tubular production column 1 which connects the wellbottom 31 which is at the level of the hydrocarbons reservoir 30, to the well head situated at the top, a tube 2 concentric with the column 1 which lines the wall of the well and at its bottom has a number of openings 4 through which the hydrocarbons pass from the reservoir into the wellbottom 31, an annular space 3 determined by the column 1 and the tube 2 and via which the excess free gas under the wellbottom thermodynamic conditions is vented, a pump 5 submerged in the hydrocarbons contained in the wellbottom 31, the outlet of which pump is connected to the bottom end of the production column 1 intended to raise the hydrocarbons, an electric motor 6 mechanically connected to the pump 5 and equipped with supply terminals 13, a frequency converter 10 with output terminals 11, powered by means of a cable 12 from an electrical network which is not depicted in FIG. 1, a power supply cable 7 for the electric motor 6 which connects the output terminals 11 of the frequency converter 10 to the power supply terminals 13 of the motor 6, a reverse-rotation sensor 8, placed on the cable 7, which on one output delivers an electrical signal when the pump 5 is running in the opposite direction to its normal direction of rotation, a current sensor 9 which, on one output, delivers an electrical signal representing the current drawn by the motor 6, an oil outlet pipe 14 connected to the top of the production column 1, via which the oil produced is conveyed towards a downstream processing unit not depicted in FIG. 1, an oil outlet choke 17 mounted on the pipe 14 and intended to regulate the flow of oil produced, an actuator 18 mechanically connected to the choke 17 and which has a control input, a pressure sensor 15 sensing the pressure upstream of the choke 17 and which on one output delivers an electrical signal proportional to the said pressure, a sensor 16 indicating the oil flow in the pipe 14, comprising an orifice plate inserted in the pipe 14 and a sensor that measures the differential pressure created across the said plate, a gas-venting pipe 19 connected to the top of the annular space 3 via which the excess gas produced is discharged, a gas venting choke 22 mounted on the pipe 19 and intended to regulate the flow of gas discharged by the pipe 19, an actuator 23 mechanically connected to the choke 22 and which has a control input, a pressure sensor 20 for sensing the pressure upstream of the choke 22, a sensor 21 for measuring the vent gas flow, a programmable controller 24 which has a number of inputs 25*a*, 25*b*, 25*c*, 25*d*, 25*e*, 25*f* and 25*g*, connected respectively to the output 28 of the frequency converter 10 and to the sensors 9, 8, 21, 20, 16, 15 and a number of outputs 26*a*, 26*b* and 26*c* connected respectively to the input 27 of the frequency converter 10 and to the control inputs of the actuators 18 and 23, operator/controller 24 dialogue means 29.

The controller 24 additionally comprises, and this is not depicted in FIG. 1, a memory pre-loaded with a program and with data needed for operating the well, particularly all the predetermined values of the regulation variables. This information being entered beforehand by an operator using the controller/operator dialogue means 29 and being modifiable during production using the same means 29.

The frequency converter 10, powered from the electrical network of a set frequency, delivers on its power output 11, an electrical voltage at a variable frequency that can be altered by a signal applied to its input 27. It also comprises a switch-circuit breaker which allows the motor 6 to be switched on and off, this being controllable by applying an electrical signal to its input 27, the said signal being emitted by the output 26*a* of the controller.

The frequency converter 10 delivers, on its output 28, a signal that represents the frequency of the voltage applied to the electric motor 6. This signal applied to the input 25*a* of the controller allows the latter to calculate the speed of the motor 6.

As the speed of the electric motor 6 is proportional to the frequency of its supply voltage, this speed can be controlled from the controller 24 by a signal delivered by the output 26*a* connected to the input 27 of the converter 10.

The hydrocarbons production well also comprises, and this is not depicted in FIG. 1, a safing device connected by an output to one input of the controller 24. The safety device comprises shut-off valves mounted on the production column 1 and on the annular space 3 and controllable by electronic modules which perform logic functions of safing the well.

Figure 5:
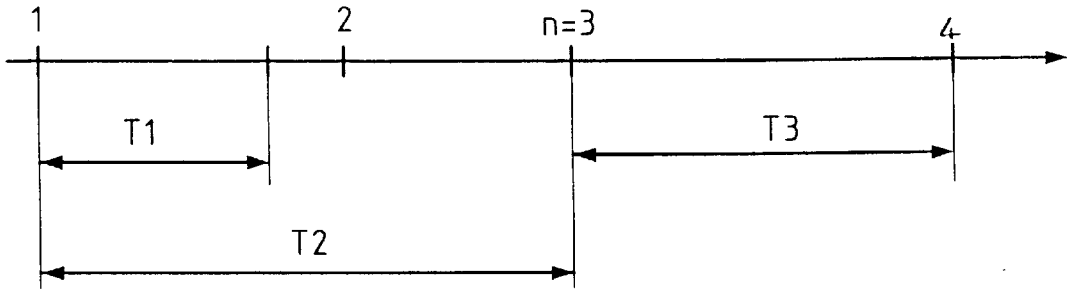
FIG. 5 is a timing diagram for attempts at starting the motor.

The method of the invention consists, during a phase of starting the well, that is to say of starting initial production or restarting after a stoppage during production, in running the following steps:

a preparative step during which the controller 24:

determines, using a control algorithm, on the basis of the signal delivered by the sensor 20 that senses the pressure upstream of the gas venting choke 22, a control value for the actuator 23 so as to bring this pressure to a predetermined starting value, determines, by means of a control algorithm, on the basis of the signal delivered by the sensor 15 that senses the pressure upstream of the oil outlet choke 17, a value for controlling the actuator 18 for bringing this pressure to a predetermined starting value, then delivers on its output 26*b* a signal for controlling the actuator 18 to close the oil outlet choke 17, next checks that, with no power applied to the electric motor 6, the condition of the pump 5 is compatible with starting, without the risk of mechanical deterioration, that is to say that the pump 5 is stopped or is running in its normal direction of rotation which will allow the hydrocarbons sucked in from the wellbottom to be delivered upwards. If it is not, if the pump 5 is running in the opposite direction to its normal direction of rotation under the effect of the natural circulation of hydrocarbons, the signal delivered by the sensor 8 is interpreted by the controller as a prohibition from starting the motor 6, checks that the time between two successive attempts at starting is greater than a predetermined value T1, so as to prevent excessive heating. For that, after each starting, the controller triggers a time counter whose content it compares, on the next start, with the value T1 predetermined on the basis of the recommendations of the manufacturer of the motor 6 and the conditions in which it is operating; this value is stored in memory in the form of a data item, checks that after a number n=3 of attempts at starting in a time T2 that the n+1, that is to say the fourth attempt does not occur until the motor has had a time T3 to cool. T1, T2 and T3 are predetermined from the characteristics of the motor and are represented on the timing diagram of FIG. 5.

A start-of-production step during which the controller 24:

delivers on the output 26*a* a signal for gradually applying power to the motor 6 until the pump 5 is running at a predetermined starting speed, checks after a time that the pressure upstream of the oil outlet choke, measured using the pressure sensor 15, exceeds a predetermined pressure-rise threshold, checks, after a time, that the current drawn by the motor 6 and measured by the sensor 9 exceeds a predetermined threshold, allows the pump 5 to continue to run if these two thresholds are exceeded, and otherwise stops the pump 5, giving the frequency converter 10 an order to stop, gradually increases the extent to which the oil outlet choke 17 is open, up to a predetermined value, waits for a predetermined stabilizing time, checks correct operation of the well by simultaneously performing checks on the current drawn by the motor 6 and on the production of the well using a production indicator, regulates the pressure upstream of the gas venting choke 22 to the predetermined starting value by action on the said choke.

In addition to the checks usually performed, which consist in comparing the current drawn by the motor 6 with very high and very low threshold values independent of the motor speed, a crossing of one of the said thresholds causing the pump to be stopped, the controller 24 compares the said current with a low threshold.

If the threshold is crossed, the controller stops the pump 5 by giving appropriate orders to the frequency converter 10.

The controller also checks the stability of the current drawn by the motor 6, in order to detect instabilities. This check consists in making sure that the current drawn by the motor 6 does not exceed high and low limits a given number of times in a given time. These various parameters are determined by taking account of the characteristics of the motor 6 and of the pump 5.

If an instability is detected, the controller stops the pump 5, by giving appropriate orders to the speed variator 10.

To perform checks on the production of the well, the controller 24 compares the oil outlet flow measured by the sensor 16 connected to the input 25*f* of the controller, with an experimentally determined threshold value. A threshold is considered to have actually been exceeded when it is exceeded continuously for a minimum length of time, so that transient crossings which do not signify anomalies are not taken into account. If a threshold is exceeded then the controller gives the frequency converter an order to stop the pump 5.

Thus, by virtue of the invention, during a phase of restarting the well, the oil outlet choke (17) does not remain closed, as this would lead to excessive heating of and damage to the motor.

After the phase of starting the well, according to the invention, the controller 24 performs the following operations simultaneously:

delivers on its output 26*a* a signal to increase the frequency of the converter 10, so as to increase the speed of the motor 6 up to a target speed value predetermined to ensure the desired oil production flow. This flow may be fixed in the form of a value entered into the controller 24 or altered as a function of the operating conditions of the unit for treating the hydrocarbons produced which is placed downstream of the well, delivers on its output 26*b* a signal for controlling the actuator 18 to open the oil outlet choke 17 up to an amount that is a function of the target speed value, calculated by applying the following formula:

$$Soil=\alpha(V-Vmin)+Smin \text{ if } Vmin<V<Vmax$$

in which:

Soil represents the extent to which the oil choke is open

V represents the target value of the speed of the electric motor 6

$\alpha$ is a constant

Smin is a constant which represents the minimum extent to which the oil choke is open Vmin and Vmax respectively represent minimum and maximum speeds of the motor, $\alpha$, Smin, Vmin and Vmax are determined from the characteristics of the well, of the pump and of the motor.

Figure 3:
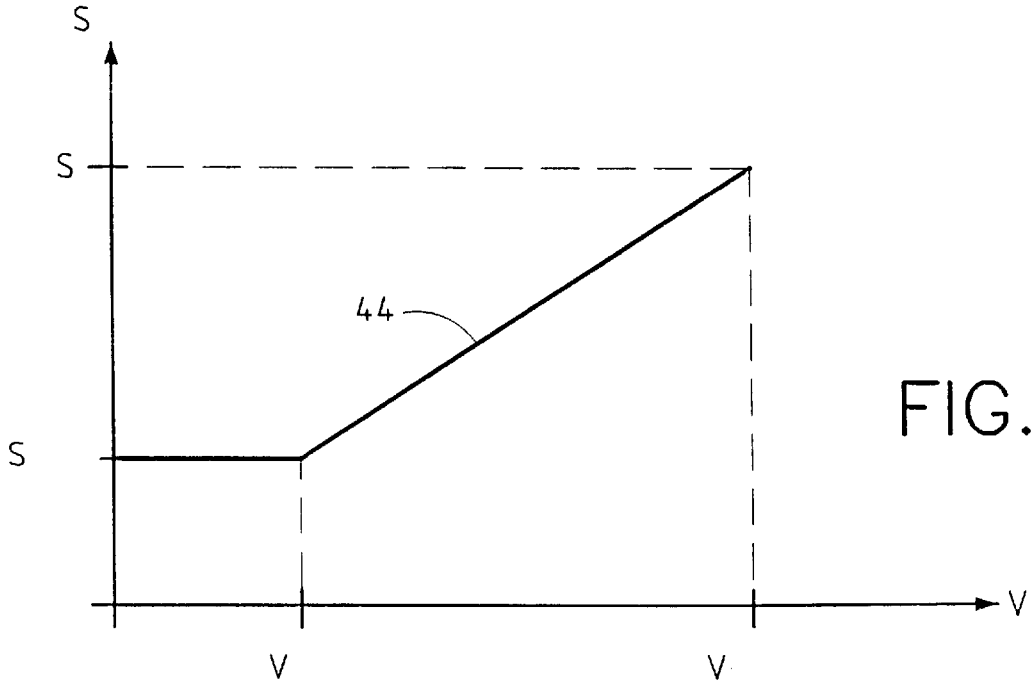
FIG. 3 represents the extent to which the oil outlet choke is open as a function of the motor speed.

FIG. 3 represents, in the form of the curve 44, the value Soil which is the extent to which the oil outlet choke 17 is open, as a function of the target value of the speed V of the motor 6.

delivers on its output 26*c* a signal for controlling the actuator 23 for keeping the pressure upstream of the gas venting choke 22 at a value that is a function of the target speed value, calculated by applying the following formula:

$$Pgas=\beta(V-Vmin)+Po \text{ if } Vmin<V<Vmax$$

in which

Pgas represents the pressure upstream of the gas venting choke 22 and measured by the sensor 20, V represents the target value of the speed of the electric motor 6

$\beta$ is a negative constant

Po is a constant

Vmin and Vmax respectively represent the minimum and maximum speeds of the motor, $\beta$, Po, Vmin and Vmax are determined from the characteristics of the well, of the pump and of the motor.

Figure 4:
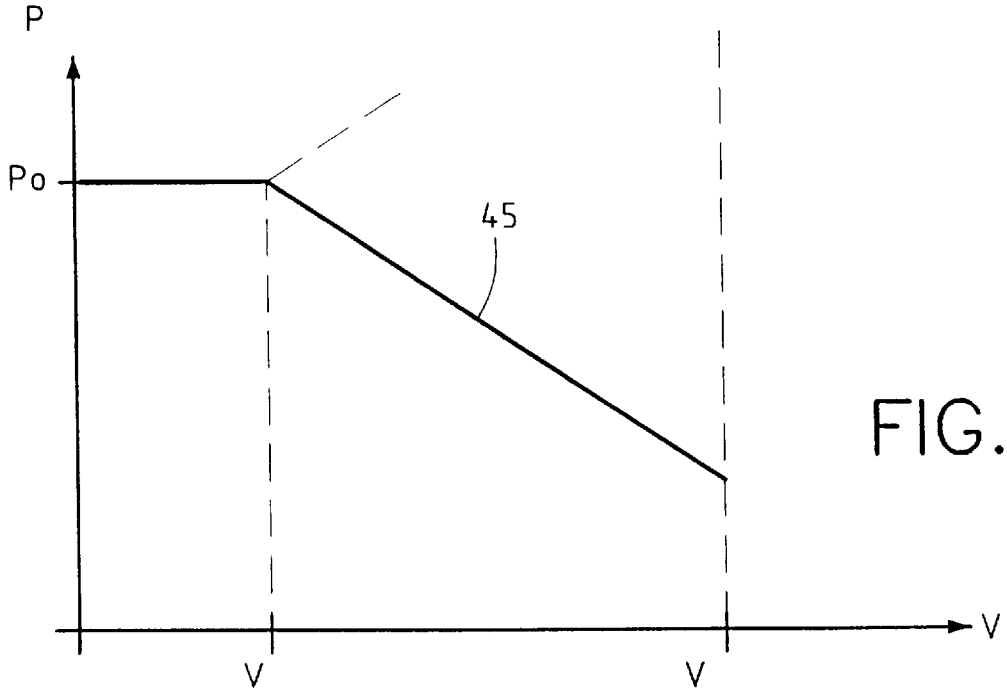
FIG. 4 represents the pressure upstream of the gas venting choke as a function of the motor speed.

FIG. 4 depicts, in the form of the curve 45, the value Pgas of the pressure upstream of the gas venting choke 22 as a function of the target value of the speed V of the motor 6.

checks correct operation of the well by simultaneously performing checks on the current drawn by the motor 6 and on the production of the well using a production indicator.

To perform checks on the current drawn by the electric motor 6, the controller compares the value of the said current with high and low thresholds that are a function of the speed of the motor 6. These thresholds are calculated by applying the following formulae:

$$Ihigh=INmin+\gamma(V-Vmin)+\Delta I \text{ if } Vmin<V<max$$

$$Ilow=INmin+\gamma(V-Vmin)-\Delta I \text{ if } Vmin<V<max$$

in which:

Ihigh represents the high threshold for current drawn by the motor 6,

Ilow represents the low threshold for current drawn by the motor 6,

V represents the speed of the electric motor 6 known by the controller from the value of the frequency of the converter 10, INmin is a constant which represents the minimum nominal value of the current drawn by the motor 6, Vmin and Vmax respectively represent the minimum and maximum values of the speed of the motor determined from characteristics of the well, of the pump 5 and of the motor 6, $\gamma$ and $\Delta I$ are constants calculated for each well, which take account of the characteristics of the motor 6 and of its actual cooling by the pumped hydrocarbons.

Figure 2:
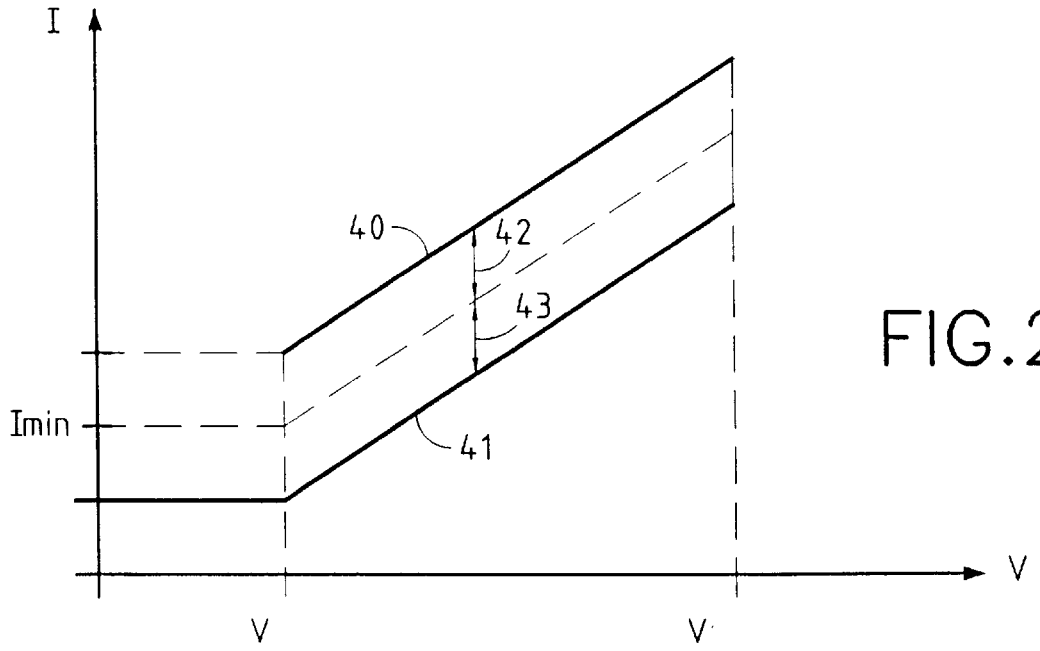
FIG. 2 represents the value of the high and low thresholds for the current drawn by the motor as a function of its speed.

FIG. 2 represents in the form of curves 40 and 41 respectively, the values Ihigh and Ilow of the high and low thresholds of the current drawn by the motor 6 as a function of the speed V of the motor. The intervals 42 and 43 in the variation of I represent $\Delta I$ and $-\Delta I$ respectively.

If a threshold is crossed, the controller reduces the speed of the motor 6 to a predetermined value, and if the threshold is still crossed after a predetermined period of time, it stops the pump 5 by giving an order to the frequency converter 10.

The controller also checks the stability of the current drawn by the motor 6 during the phase following starting, so as to detect instabilities which characterize swift variations in the conditions of flow of the hydrocarbons due, for example, to the presence of an excessive amount of gas at the pump, and which may in particular lead to deterioration of the motor 6 and of the pump 5. This check consists in making sure that the current drawn by the motor 6 does not exceed a high limit a given number of times in a given time. These various parameters are determined by taking account of the characteristics of the motor 6 and of the pump 5.

If an instability is detected, the controller reduces the speed of the motor 6 to a predetermined value, and if the instability is still present, stops the pump 5, by giving suitable orders to the frequency converter 10.

To carry out checks on the production of the well, the controller 24 compares the oil outlet flow measured by the sensor 16 connected to the input 25*f* of the controller, with predetermined high and low threshold values. A crossing of a threshold is considered to have actually occurred when it is continuous for a minimum length of time, so that transient crossings which do not signify anomalies are not taken into account. If a threshold is exceeded then the controller reduces the motor speed and gives the frequency converter an order to stop the pump 5 if the fault persists.

method of the invention also consists in coordinating the operating actions with the well safing actions. When the safing device triggers a series of safing actions it simultaneously delivers a signal on an output connected to an input of the controller 24. The latter interprets this signal and issues the orders to close the oil outlet and gas venting chokes, to stop the motor 6, which have the effect of reinforcing the safing actions.

Another advantage of the invention is that it protects the pump against excessively wide or excessively prolonged opening of the oil outlet choke, which might be unsuitable for the characteristics of the pump. It also allows the pump to run in the presence of free gas because, by its actions of active monitoring, it guarantees that the well operating conditions are acceptable.

By virtue of the method of the invention, the motor is protected against deterioration by heating under all running conditions, particularly at low speed during the starting phases and during the start-of-production phases while at the same time allowing maximum production of hydrocarbons.

The invention also makes it possible to protect the well equipment, particularly the motor and the pump, from mechanical and hydraulic shocks thanks to the simultaneous actions on the oil outlet and gas venting chokes and on the motor speed.

EXAMPLE

The values of parameters used for implementing the method of the invention for operating a hydrocarbons production well from a reservoir lying at a depth of 650 meters, the static wellbottom pressure of which was 50 bar will be found below by way of example. This well, equipped with a tubular production column 114 mm in diameter surrounded by a concentric tube 244 mm in diameter was activated by a pumping system, comprising, placed in the wellbottom, a submerged 36-stage pump driven by a 200 kW electric motor.

The electrical power supply for the motor was provided by a 360 kVA frequency converter allowing an operating range of 1600 to 2700 $m^3$/day of hydrocarbons pumped, the frequency of the current delivered being between 47 and 61 Hz, which corresponds to a minimum speed of 2740 rpm and a maximum speed of 3560 rpm.

The nominal current drawn by the motor was 77 A at 50 Hz under a voltage of 2000 V.

The target speed was equal to the maximum motor speed.

After a restart following a production stoppage, during the step in preparation for the starting phase, the pressure upstream of the gas venting choke was brought to 20 bar and the pressure upstream of the oil outlet choke was brought to 17 bar.

The minimum time to be waited between two successive attempts at starting was 20 min.

The minimum time to be waited after three attempts at starting in a period of 120 min was 60 min.

During the start-of-production step, the minimum speed reached by the motor after the gradual application of power thereto corresponded to a supply frequency of 47 Hz, namely to 2740 rpm.

The threshold for the rise in pressure upstream of the oil outlet choke was 20 bar and the threshold above which the current drawn by the motor had to lie was 36 A.

The extent to which the oil outlet choke was open, achieved after it had been gradually increased, was 70%.

The low threshold with which the current drawn by the motor was compared, to perform the check on the said current in order to check correct operation, was 36 A.

The stability of the current drawn by the motor was checked by making sure that the value of the said current did not exceed, more than five times in one minute, its mean value calculated over a period of time of 60 seconds, increased by 3 A.

As the production indicator chosen for checking correct operation was a pressure difference across an orifice, converted into an oil flow rate, the threshold with which it was compared was 1000 $m^3$/day.

The pressure upstream of the gas venting choke was regulated to the predetermined starting value, namely 20 bar.

After the starting phase, the motor speed was increased to a target value which was obtained by setting the frequency of the supply current to 61 Hz, namely 3560 rpm.

At the same time, the oil outlet choke was opened up to a value that was calculated as a function of the speed, using the following formula:

$$Soil=\alpha(V-Vmin)+Smin \text{ if } Vmin<V<Vmax$$

in which:

Soil represents the extent to which the oil outlet choke is open

V represents the target value of the speed of the electric motor $\alpha$ is a constant equal to 0.036

Smin is a constant equal to 70% which represents the minimum extent to which the oil outlet choke is open Vmin=2740 rpm and Vmax=3560 rpm, respectively represent the minimum and maximum speeds of the motor, A value Soil=100% was thus obtained.

The position of the gas venting choke was adjusted so as to keep the pressure upstream of the said choke at a value calculated according to the following formula as a function of the speed of the motor:

$$Pgas=\beta(V-Vmin)+Po \text{ if } Vmin<V<Vmax$$

in which

Pgas represents the pressure upstream of the gas venting choke,

V represents the target value of the speed of the electric motor

β is a constant equal to −0.01

Po is a constant equal to 20 bar

Vmin=2740 rpm and Vmax=3560 rpm, respectively represent the minimum and maximum speeds of the motor, The thresholds for the current drawn by the electric motor for performing checks on this current were calculated by applying the following formulae:

$$Ihigh=INmin+\gamma(V-Vmin)+\Delta I \text{ if } Vmin<V<Vmax$$

$$Ilow=INmin+\gamma(V-Vmin)-\Delta I \text{ if } Vmin<V<Vmax$$

in which:

Ihigh represents the high threshold for current drawn by the motor,

Ilow represents the low threshold for current drawn by the motor,

V represents the speed of the electric motor in rpm,

INmin=40 A represents the nominal minimum value of the current drawn by the motor, Vmin=3560 rpm and Vmax=3560 rpm respectively represent the minimum and maximum values of the speed of the motor determined from the characteristics of the well, of the pump and of the motor, γ=0.034 and Δ=4 A are constants which were calculated for the well in question and which take account of the characteristics of the motor and of its actual cooling by the pumped hydrocarbons.

The stability of the current drawn by the motor was checked by making sure that the value of the said current did not exceed more than five times in one minute its mean value calculated over a period of time of 60 seconds, increased by 3 A, as in the starting phase.

When the target speed was reached, the production indicator, converted into an oil flow rate, was compared with the thresholds of 2400 and 3000 $m^3$/day.

The value to which the speed was reduced in the event of a crossing of a threshold for checking correct operation was equal to the value of the corresponding speed at the frequency of the supply current equal to 47 Hz, namely 2740 rpm.

During and after the starting phase, the very high and very low thresholds independent of the speed of the motor were equal to 80 A and 36 A respectively.

What is claimed is:

1. Method of operating an oil and gas production well activated by a pumping system, comprising, placed at the wellbottom, a submerged pump (5) driven by an electric motor (6) which draws a known amount of current, the said well comprising, at its top, an oil-outlet choke (17) and a gas venting choke (22), characterized in that it comprises a starting phase which consists in running the following steps:

a preparative step which consists in:

acting on the gas venting choke (22) to bring the pressure upstream of the said choke to a predetermined starting value, acting on the oil outlet choke (17) to bring the pressure upstream of the said choke to a predetermined starting value, re-closing the oil outlet choke (17), checking that, with no power applied to the electric motor (6), the condition of the pump (5) is compatible with starting, a start-of-production step which consists in:

gradually applying power to the motor (6) until the pump (5) is running at a predetermined minimum speed, checking, after a time, that the pressure upstream of the oil outlet choke (17) has exceeded a predetermined pressure-rise threshold, checking, after a time, that the current drawn by the electric motor (6) has exceeded a predetermined threshold, leaving the pump (5) running if these two thresholds have been exceeded, otherwise stopping the pump (5), gradually increasing the extent to which the oil outlet choke (17) is open, up to a predetermined value, waiting for a predetermined stabilizing time, checking for correct operation by simultaneously making checks on the current drawn by the motor (6) and on the production of the well using at least one production indicator, regulating the pressure upstream of the gas venting choke to the predetermined starting value.

2. Method according to claim 1, wherein the compatibility of the condition of the pump (5) with starting comprises the following checks:

that the pump (5), rotating and equipped with a direction-of-rotation sensor (8) is not running in the opposite direction to its normal direction of rotation, that the time between two successive attempts at starting exceeds a predetermined value (T1), that after a predetermined number (n) of attempts at starting in a predetermined time (T2), the next attempt does not occur until a predetermined time (T3) has elapsed.

3. Method according to claim 1, wherein with the current drawn by the motor (6) being compared with very high and very low thresholds independent of the speed of the motor (6), a crossing of one of the said thresholds causing the pump (5) to be stopped, the checks on the current drawn by the electric motor (6) for checking correct operation, additionally consist in:

comparing the value of the said current with a low threshold and, if the threshold has been crossed and if the time for which it is crossed exceeds a predetermined value, stopping the pump (5), after a predetermined time, checking the stability of the said current and if an instability is detected and if the duration of the instability exceeds a predetermined value, stopping the pump (5).

4. Method according to claim 1, wherein the checks on the production of the well consist in taking as a production indicator at least one physical variable that indicates the oil outlet flow and in comparing the value of the said variable with a predetermined threshold, the threshold being considered as actually having been exceeded when it is so continuously for a predetermined duration, and if the threshold has been exceeded, in stopping the pump (5).

5. Method according to claim 4 wherein the physical variable that indicates the oil outlet flow is chosen from the group consisting of a pressure difference created by a restriction on the oil outlet, the vent gas flow, the wellbottom pressure upstream of the pump (5), the pressure upstream of the oil outlet choke (17) and the oil outlet temperature.

6. Method according to claim 1, wherein after the starting phase it consists in simultaneously performing the following operations:

increasing the speed of the motor (6) up to a predetermined target value, opening the oil outlet choke up to a value that is calculated as a function of the target value of the speed of the motor (6), acting on the gas venting choke (22) so as to keep the pressure upstream of the said choke at a value that is calculated as a function of the target value of the speed of the motor (6), then checking for correct operation by performing checks on the current drawn by the motor (6) and on the well production, using production indicators.

7. Method according to claim 6, wherein the extent to which the oil outlet choke (17) is open is calculated by applying the following formula:

$$Soil=\alpha(V-Vmin)+Smin \text{ if } Vmin<V<Vmax$$

in which:

Soil represents the extent to which the oil outlet choke (17) is open

V represents the target value of the speed of the electric motor (6)

$\alpha$ is a constant

Smin is a constant which represents the minimum extent to which the oil outlet choke (17) is open Vmin and Vmax respectively represent the minimum and maximum speeds of the motor (6), $\alpha$, Smin, Vmin and Vmax are determined from characteristics of the well, of the pump (5) and of the motor (6).

8. Method according to claim 6, wherein the pressure upstream of the gas venting choke (22) is calculated by applying the following formula:

$$Pgas=\beta(V-Vmin)+Po \text{ if } Vmin<V<Vmax$$

in which

Pgas represents the pressure upstream of the gas venting choke (22),

V represents the target value of the speed of the electric motor (6)

$\beta$ is a constant

Po is a constant

Vmin and Vmax respectively represent the minimum and maximum speeds of the motor (6), $\beta$, Po, Vmin and Vmax are determined from characteristics of the well, of the pump (5) and of the motor (6).

9. Method according to claim 6, wherein with the current drawn by the motor (6) being compared with very high and very low thresholds independent of the speed of the motor (6), a crossing of one of the said thresholds causing the pump (5) to be stopped, the checks on the current drawn by the electric motor (6) for checking correct operation, additionally consist in:

comparing the value of the said current with high and low thresholds which vary as a function of the speed of the motor (6), if a threshold is crossed, reducing the speed, and if the threshold is still crossed, stopping the pump (5), checking the stability of the said current, and if an instability is detected, reducing the speed to a predetermined value, and if the duration of the instability exceeds a predetermined value, stopping the pump (5).

10. Method according to claim 9, wherein the high and low thresholds that vary as a function of the speed are calculated by applying the following formulae:

$$Ihigh=INmin+\gamma(V-Vmin)+\Delta I \text{ if } Vmin<V<Vmax$$

$$Ilow=INmin+\gamma(V-Vmin)-\Delta I \text{ if } Vmin<V<Vmax$$

in which:

Ihigh represents the high threshold for the current drawn by the motor (6),

Ilow represents the low threshold for the current drawn by the motor (6),

V represents the speed of the electric motor (6),

INmin is a constant which represents the minimum nominal value of the current drawn by the motor (6), Vmin and Vmax respectively represent the minimum and maximum values of the speed of the motor (6) determined from characteristics of the well, of the pump (5) and of the motor (6), $\gamma$ and $\Delta I$ are constants calculated for each well from characteristics of the motor (6).

11. Method according to claim 6, wherein the checks on the production of the well consist in taking as a production indicator at least one physical variable that indicates the oil outlet flow and in comparing the value of the said variable with at least one predetermined threshold, the threshold being considered as actually having been exceeded when it is so continuously for a predetermined duration, and if the threshold has been exceeded, in reducing the speed.

12. Method according to claim 1, wherein with the well being equipped with a safety device, the method consists in closing the oil outlet and gas venting chokes (17 and 22) and in stopping the motor (6) immediately when the safety device comes into action.

13. Method of operating an oil and gas production well activated by a pumping system, comprising, placed at the wellbottom, a submerged pump (5) driven by an electric motor (6) which draws a known amount of current, the said well comprising, at its top, an oil-outlet choke (17) and a gas venting choke (22), characterized in that after a starting phase it consists in simultaneously performing the following operations:

increasing the speed of the motor (6) up to a predetermined target value, opening the oil-outlet choke (17) up to a value that is calculated as a function of the target value of the speed of the motor (6), acting on the gas venting choke (22) so as to keep the pressure upstream of the said choke at a value that is calculated as a function of the target value of the speed of the motor (6), then checking for correct operation by performing checks on the current drawn by the motor (6) and on the well production, using production indicators.

14. Method according to claim 13, wherein the extent to which the oil outlet choke (17) is open is calculated by applying the following formula:

$$Soil=\alpha(V-Vmin)+Smin \text{ if } Vmin<V<Vmax$$

in which:

Soil represents the extent to which the oil outlet choke (17) is open

V represents the target value of the speed of the electric motor (6)

α is a constant

Smin is a constant which represents the minimum extent to which the oil outlet choke (17) is open Vmin and Vmax respectively represent the minimum and maximum speeds of the motor (6), α, Smin, Vmin and Vmax are determined from characteristics of the well, of the pump (5) and of the motor (6).

15. Method according to claim 13, wherein the pressure upstream of the gas venting choke (22) is calculated by applying the following formula:

$$Pgas=\beta(V-Vmin)+Po \text{ if } Vmin<V<Vmax$$

in which:

Pgas represents the pressure upstream of the gas venting choke (22),

V represents the target value of the speed of the electric motor (6),

β is a constant

Po is a constant

Vmin and Vmax respectively represent the minimum and maximum speeds of the motor (6), β, Po, Vmin and Vmax are determined from characteristics of the well, of the pump (5) and of the motor (6).

16. Method according to claim 13, wherein with the current drawn by the motor (6) being compared with very high and very low thresholds independent of the speed of the motor (6), a crossing of one of the said thresholds causing the pump (5) to be stopped, the checks on the current drawn by the electric motor (6) for checking correct operation, additionally consist in:

comparing the value of the said current with high and low thresholds calculated as a function of the speed of the motor (6), if a threshold is crossed, reducing the speed and if the threshold is still crossed, stopping the pump (5), checking the stability of the said current, and if an instability is detected, reducing the speed to a predetermined value, and if the duration of the instability exceeds a predetermined value, stopping the pump (5).

17. Method according to claim 16, wherein the high and low thresholds are calculated by applying the following formulae:

$$Ihigh=INmin+\gamma(V-Vmin)+\Delta I \text{ if } Vmin<V<Vmax$$

$$Ilow=INmin+\gamma(V-Vmin)-\Delta I \text{ if } Vmin<V<Vmax$$

in which:

Ihigh represents the high threshold for the current drawn by the motor (6),

Ilow represents the low threshold for the current drawn by the motor (6),

V represents the speed of the electric motor (6),

INmin is a constant which represents the minimum nominal value of the current drawn by the motor (6), Vmin and Vmax respectively represent the minimum and maximum values of the speed of the motor (6) determined from characteristics of the well, of the pump (5) and of the motor (6), γ and ΔI are constants calculated for each well from characteristics of the motor (6).

18. Method according to claim 13, wherein the checks on the production of the well consist in taking as a production indicator at least one physical variable that indicates the oil outlet flow and in comparing the value of the said variable with at least one predetermined threshold, the threshold being considered as actually having been exceeded when it is so continuously for a predetermined duration, and if the threshold has been exceeded, in reducing the speed.

19. Method according to claim 18, wherein the physical variable that indicates the oil outlet flow is chosen from the group consisting of a pressure difference created by a restriction on the oil outlet, the vent gas flow, the wellbottom pressure upstream of the pump (5), the pressure upstream of the oil outlet choke (17) and the oil outlet temperature.

20. Method according to claim 13, wherein with the well being equipped with a safety device, the method consists in closing the oil outlet and gas venting chokes (17 and 22) and in stopping the motor (6) immediately when the safety device comes into action.

* * * * *